US006805199B2

(12) United States Patent
Surjaatmadja

(10) Patent No.: US 6,805,199 B2
(45) Date of Patent: Oct. 19, 2004

(54) PROCESS AND SYSTEM FOR EFFECTIVE AND ACCURATE FOAM CEMENT GENERATION AND PLACEMENT

(75) Inventor: Jim B. Surjaatmadja, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 34 days.

(21) Appl. No.: 10/272,958

(22) Filed: Oct. 17, 2002

(65) Prior Publication Data

US 2004/0074645 A1 Apr. 22, 2004

(51) Int. Cl.[7] ..... E21B 33/13
(52) U.S. Cl. ..... 166/309; 166/285
(58) Field of Search ..... 166/67, 68, 105, 166/300, 309, 310, 316, 222, 285

(56) References Cited

U.S. PATENT DOCUMENTS

| | | | | | |
|---|---|---|---|---|---|
| 4,275,788 | A | * | 6/1981 | Sweatman | 166/292 |
| 4,730,676 | A | * | 3/1988 | Luers et al. | 166/309 |
| 4,797,003 | A | * | 1/1989 | Cameron et al. | 366/101 |
| 5,249,628 | A | | 10/1993 | Surjaatmadja | 166/308 |
| 5,358,047 | A | * | 10/1994 | Himes et al. | 166/280 |
| 5,494,103 | A | | 2/1996 | Surjaatmadja et al. | 166/222 |
| 5,765,642 | A | | 6/1998 | Surjaatmadja | 166/297 |
| 6,062,311 | A | | 5/2000 | Johnson et al. | 166/312 |
| 6,206,113 | B1 | | 3/2001 | Michael | 175/71 |
| 6,286,599 | B1 | | 9/2001 | Surjaatmadja et al. | 166/298 |
| 6,286,600 | B1 | | 9/2001 | Hall et al. | 166/305.1 |
| 6,397,864 | B1 | | 6/2002 | Johnson | 134/167 C |
| 6,520,256 | B2 | * | 2/2003 | Ferg | 166/285 |
| 6,602,916 | B2 | * | 8/2003 | Grundmann et al. | 516/10 |
| 6,622,791 | B2 | * | 9/2003 | Kelley et al. | 166/313 |
| 6,662,874 | B2 | * | 12/2003 | Surjaatmadja et al. | 166/309 |

* cited by examiner

*Primary Examiner*—Frank Tsay
(74) *Attorney, Agent, or Firm*—John W. Wustenberg; Anthony L. Rahhal

(57) ABSTRACT

A method and apparatus for generating foam cement and placing foam cement in an annulus between a casing and a wellbore. The method includes the steps of displacing cement downwardly in the casing and injecting a gas, preferably nitrogen, into the cement at a predetermined location downhole in the casing. The nitrogen may be injected through a ported sub. The ported sub may be connected in a tubing string that is lowered in the casing. The ported sub has a plurality of ports, which may have nozzles connected therein, that communicate a central opening through the ported sub with an annulus between the ported sub and the casing. The rate at which nitrogen is injected into the cement preferably increases from a leading edge of the cement to a trailing edge of the cement so that a consistent foam cement quality is achieved.

31 Claims, 5 Drawing Sheets

PROCESS AND SYSTEM FOR EFFECTIVE AND ACCURATE FOAM CEMENT GENERATION AND PLACEMENT

BACKGROUND OF THE INVENTION

The present invention is directed to a method and apparatus for generating and placing foam cement across a long interval behind casing in a wellbore. The invention is more particularly directed to a method and apparatus for generating foam cement downhole in the casing.

Hydraulic cement slurries are commonly utilized in subterranean well operations. For example, hydraulic cement slurries are used in primary well cementing operations whereby strings of pipe such as casing and liners are cemented in wellbores. In performing primary cementing, a hydraulic cement slurry is pumped into the annular space between the walls of a wellbore and the exterior surfaces of a pipe string disposed therein. The cement slurry is permitted to set in the annular space thereby forming an annular sheath of hardened substantially impermeable cement therein. The cement sheath physically supports and positions the pipe string in the wellbore and bonds the exterior surfaces of the pipe string to the walls of the wellbore whereby the undesirable migration of fluids between zones or formations penetrated by the wellbore is prevented.

In well applications, the cement slurries must often be lightweight to prevent excessive hydrostatic pressure from being exerted on subterranean formations penetrated by the wellbore whereby the formations are unintentionally fractured. As a result, a variety of lightweight cement slurries, including foam cement slurries, have been developed and used. In addition to being lightweight, a foam cement slurry contains compressed gas which improves the ability of the slurry to maintain pressure and prevent the flow of formation fluids into and through the cement slurry during its transition time, i.e., the time during which the cement slurry changes from a true fluid to a hard set mass. Foam cement compositions are also advantageous because they have low fluid loss properties. Foam cement slurries often include various surfactants known as foaming agents to facilitate the foaming of the cement slurry when gas is mixed therewith. Other surfactants known as foam stabilizers may be added for preventing the foam slurries from prematurely separating into slurry and gas components. The foam slurry comprises a hydraulic cement, water present in an amount sufficient to form a pumpable slurry, a mixture of foaming and foam stabilizing surfactants to form and stabilize the foam cement slurry, and sufficient gas to foam the slurry. As is known in the art, a variety of other additives may be added to the slurry to provide desired characteristics.

The present means of foaming the slurry generally comprises mixing cement and a gas, preferably nitrogen, at low pressures and injecting the slurry into the well. The gas utilized to foam the cement slurry, which may be air or nitrogen, but is preferably nitrogen, is typically added to the cement at the surface, and the slurry is then pumped downhole through the casing and then into the annulus between the casing and the wellbore. Gas must be added in an amount sufficient so that the foam slurry, when it is in place between the casing and the annulus, has a quality of approximately 18% to 38%. In other words, nitrogen must be present in the range of up to approximately 38% by volume of the slurry at the desired pressure. If the quality of the cement varies from the desired range, the cement bond and strengths may be unacceptable.

For a fixed foam quality, the amount of nitrogen in the slurry will vary drastically from the top of cement (TOC) to the tail, or bottom of cement, due to hydrostatic pressure. Generally, at some point in the well, the pressure of the slurry is below 500 psi. If the cement is designed to have 35–38% quality at 500 psi, then quality at depths in the well where the pressure is greater than 500 psi will be lower. For example, if the well is about 10,000 feet deep, with a bottom hole pressure of about 5150 psi, the desired cement density may be about 10 lb/gal, which corresponds to about 37% quality. If at 500 psi the quality is 38% then Vgas/(Vgas+Vliquid)=0.38, or Vliq=1.63 Vgas. When pressure is increased to 5150 psi, gas volume changes to 500 Vgas/5150. The new quality is thus 0.097 Vgas/(0.097 Vgas+Vliq)=0.097 Vgas/(0.097 Vgas+1.63 Vgas)=0.056 or 5.6%. Thus, the desired quality is not achieved. If the cement is designed for 37% quality at 5150 psi, then Vliq 1.63 Vgas at 5150 psi. When pressure decreases from 5150 to 500, gas volume changes to 5150 Vgas/500=0.863 or 86.3%. Such a quality is unstable, and gas bubbles will break into larger gas bubbles. It is therefore difficult and sometimes impossible to achieve desired cement quality using present technology. Thus, there is a need for a method and apparatus that will provide consistent cement foam qualities from the top of the cement to the tail or trailing edge.

SUMMARY OF THE INVENTION

The current invention provides a method and apparatus for the generation of and placement of foam cement. The method includes displacing cement downwardly through a casing so that it exits the casing and enters an annulus between the casing and a wellbore. A gas is injected into the cement at a location downhole in the casing to foam the cement. Once a sufficient amount of cement has been displaced to fill the annulus between the casing and the wellbore, the flow of cement is stopped. The method may include placing nozzles downhole in the casing and injecting the gas through the nozzles. The placement step may comprise connecting a ported sub to a tubing and lowering the tubing into the casing until the ported sub is positioned at a desired location in the casing. The ported sub may have openings therethrough, which may be referred to as nozzles, through which the gas is injected. A tubing dead string may be connected to the ported sub, and the tubing lowered into the casing until it engages the bottom of the casing, which may comprise a float shoe. If the casing includes a float collar above a float shoe, the tubing will engage the float collar. Once the tubing engages the float apparatus, whether a float collar or float shoe, the tubing is then lifted to provide clearance between the end of the tubing and the float apparatus. The injecting step will thus comprise injecting nitrogen through the tubing and through openings in the ported sub into the annulus between the casing and the tubing to foam the cement.

A bottom cementing plug is preferably placed in the casing ahead of a leading edge of the cement. The bottom cementing plug may have outer wipers and inner wipers so that the bottom cementing plug will wipe the inner surface of the casing and the outer surface of the tubing utilized to lower the ported sub into the casing. The injecting step preferably begins when the bottom cementing plug passes the ported sub. The rate at which nitrogen is injected into the cement may be increased from the leading edge to the trailing edge of the cement so as to acquire a consistent cement quality once the cement is placed in the annulus between the casing and the wellbore. Preferably, the rate of nitrogen injected in the cement is increased at a constant rate from the leading edge to the trailing edge. A top cementing plug is placed in the casing behind the trailing edge of the cement and is displaced downwardly with a displacement fluid. Once the top cementing plug passes the ported sub, the injection of gas ceases.

DETAILED DESCRIPTION OF A PREFERRED EMBODIMENT

Figure 1:
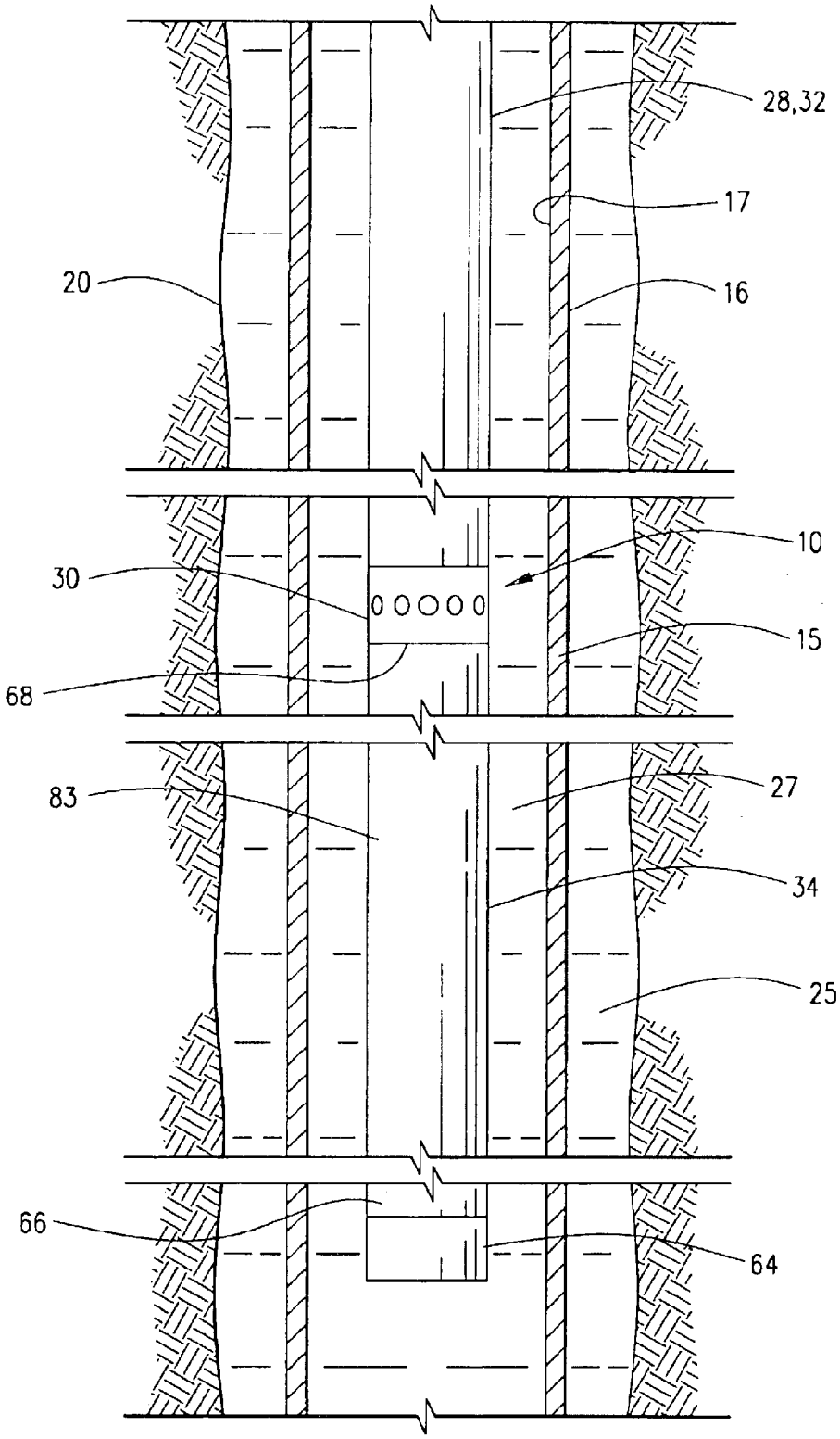
FIG. 1 schematically shows a casing in a wellbore with a tubing including the foaming tool of the present invention located therein.

Referring now to the drawings and more particularly to FIG. 1, foaming apparatus 10 according to the present invention is shown disposed in a casing 15. Casing 15 has an outer surface 16 and an inner surface 17. Casing 15 is shown in a wellbore 20, which may be drilled by any conventional means. Casing 15 may be suspended in wellbore 20 by any means known in the art. An annulus 25 which may be referred to as outer annulus 25 is defined between casing 15 and wellbore 20. An annulus 27 which may be referred to as inner annulus 27 is defined between foaming apparatus 10 and inner surface 17 of casing 15. Foaming apparatus 10 includes tubing 28 having a foamer 30 which may be referred to as a jetting, or ported sub 30 connected therein. Tubing 28 may comprise jointed or coiled tubing and includes an upper tubing portion 32 and a lower tubing portion 34 with the foamer 30 being disposed or connected therebetween. Tubing 28 may be lowered into and suspended in casing 15 by any means known in the art. Foamer 30 may be threadedly connected, or connected by couplings or other means known in the art to upper tubing portion 32 and lower tubing portion 34.

Figure 3:
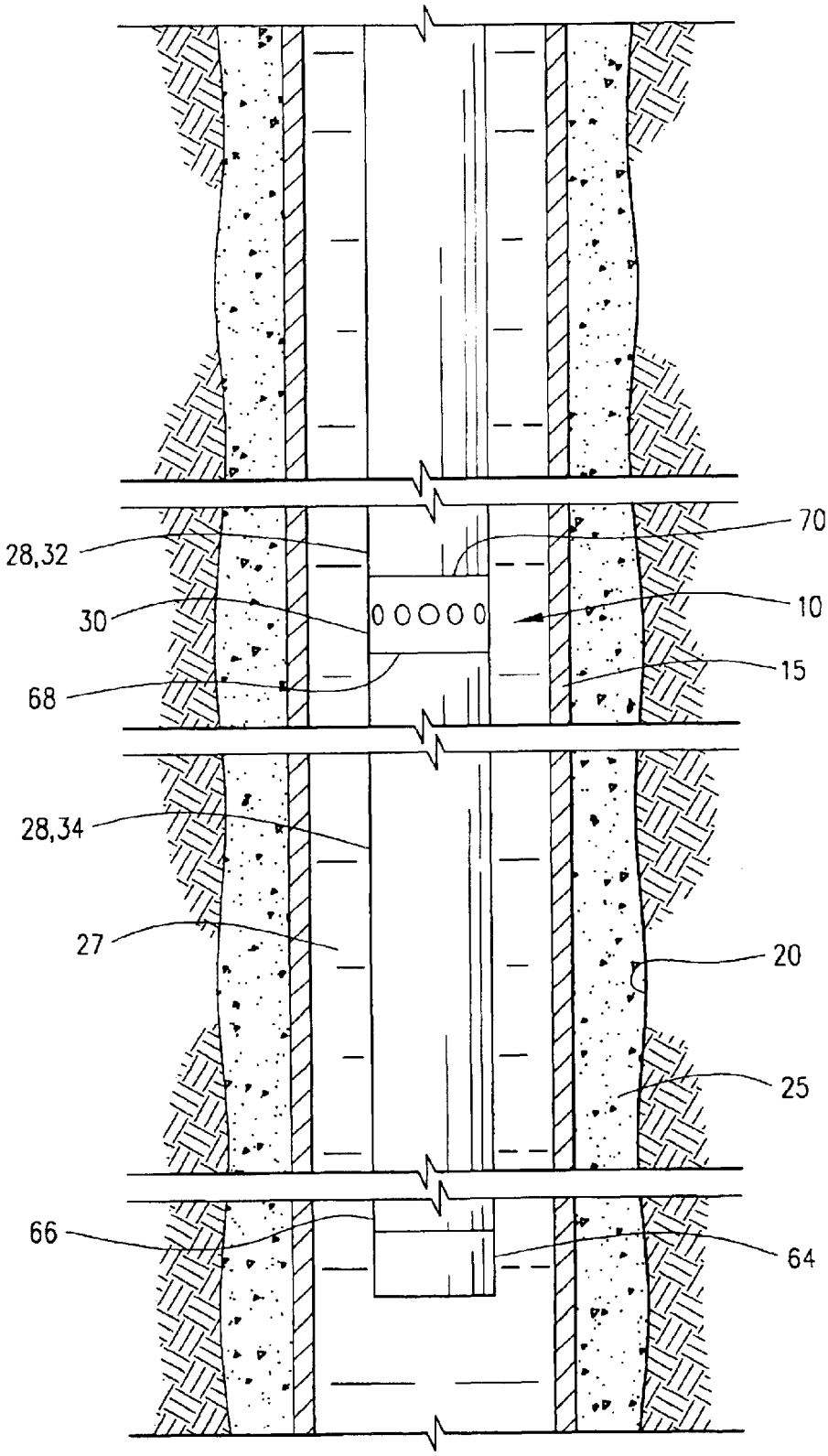
FIG. 3 is similar to FIG. 2 and shows the foaming apparatus after cementing operations have been completed.
Figure 4:
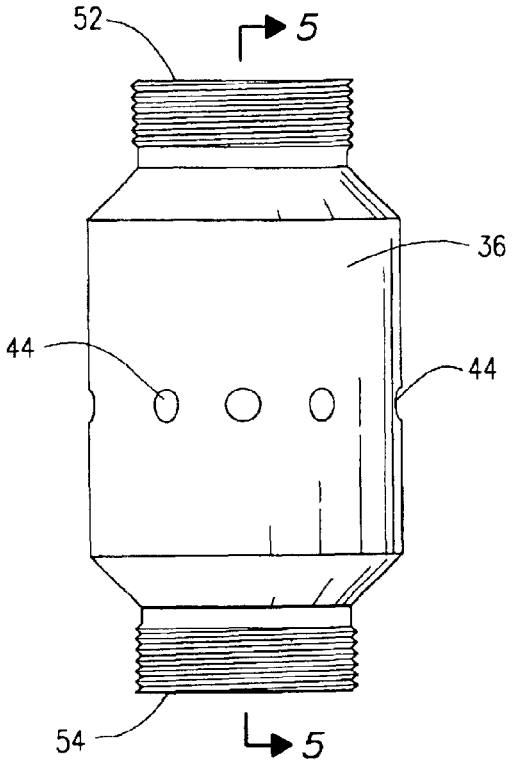
FIG. 4 is a side elevation view of the foaming apparatus of the present invention.
Figure 5:
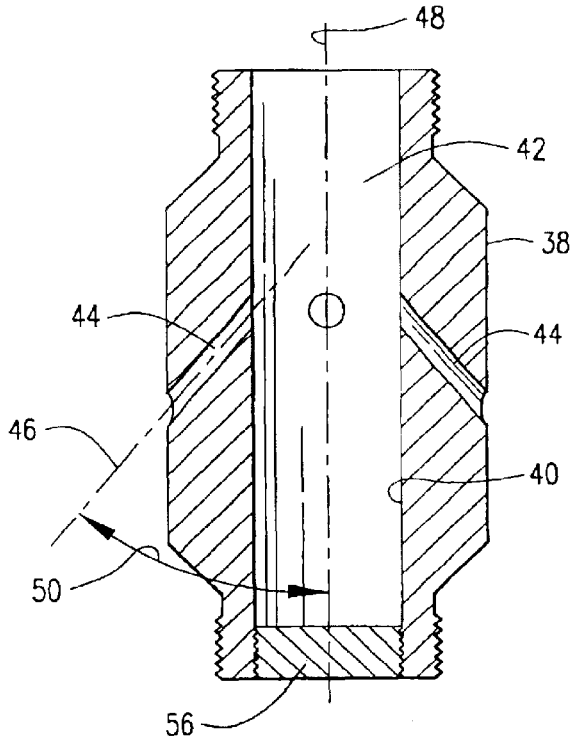
FIG. 5 is a view taken from line 5—5 of FIG. 4.

Foamer 30, as shown in FIGS. 4 and 5, comprises a roamer body 36 having an outer surface 38 and an inner surface 40 which defines a central opening or passageway 42 that communicates with upper tubing portion 32. A plurality of ports 44 communicate central opening 42 with the exterior of roamer 30. Ports 44 thus communicate central opening 42 with inner annulus 27. Ports 44 each have an axis 46, which is angled from a longitudinal central axis 48 of central opening 42. An angle 50 between axis 46 and longitudinal central axis 48 is preferably in the range of about 15° to 30° so that the ports 44 are angled downwardly approximately 15° to 30°. Foamer 30 has an upper end 52 and a lower end 54. Lower end 54 is plugged and thus preferably has a threaded plug 56 therein. Foamer 30 may be made as one piece so that plug 56 is integrally formed therewith. Ports 44 may be referred to as jets, or nozzles. It is understood that nitrogen or other gas may be jetted directly through ports 44, or that separate nozzles may be threaded into openings defined in foamer or ported sub 30. A bull plug 64 is connected to lower end 66 of tubing 28 which comprises a lower end of lower tubing portion 34 as shown in FIG. 1. Lower tubing portion 34 thus has lower end 66 and upper end 68 while upper tubing portion 32 has lower end 70 as shown in FIG. 3. Foamer 30 is connected at its upper end 52 to the lower end 70 of upper tubing portion 32 and is connected at its lower end 54 to the upper end 68 of lower tubing portion 34.

The operation of the invention is evident from the drawings. FIG. 1 shows foaming apparatus 10 being lowered into casing 15. Lower tubing portion 34, which may be jointed or coiled tubing, may be filled with a fluid and essentially is utilized to guide foaming apparatus 10 into casing 15, and as will be explained in more detail hereinbelow to guide cementing plugs downwardly in casing 15. Alternatively, bull plug 64 may have openings therein so that fluid may be allowed to fill lower tubing portion 34 as it is lowered into casing 15. Since lower tubing portion 34 acts as a guide, it is preferably a relatively short section, and should not be longer than approximately 37% of the total depth of the well. Foamer 30 is connected to the upper end 68 of lower tubing portion 34 and is connected to upper tubing portion 32 so that it may be lowered into casing 15. Foaming apparatus 10 is lowered into casing 15 and may be lowered to a float apparatus connected in casing 15. Once foaming apparatus 10 reaches the float apparatus in the casing 15, foaming apparatus 10 is lifted upwardly so that there is clearance between the lower end of tubing 28, in this case bull plug 64, and the float apparatus in the casing 15.

Figure 2:
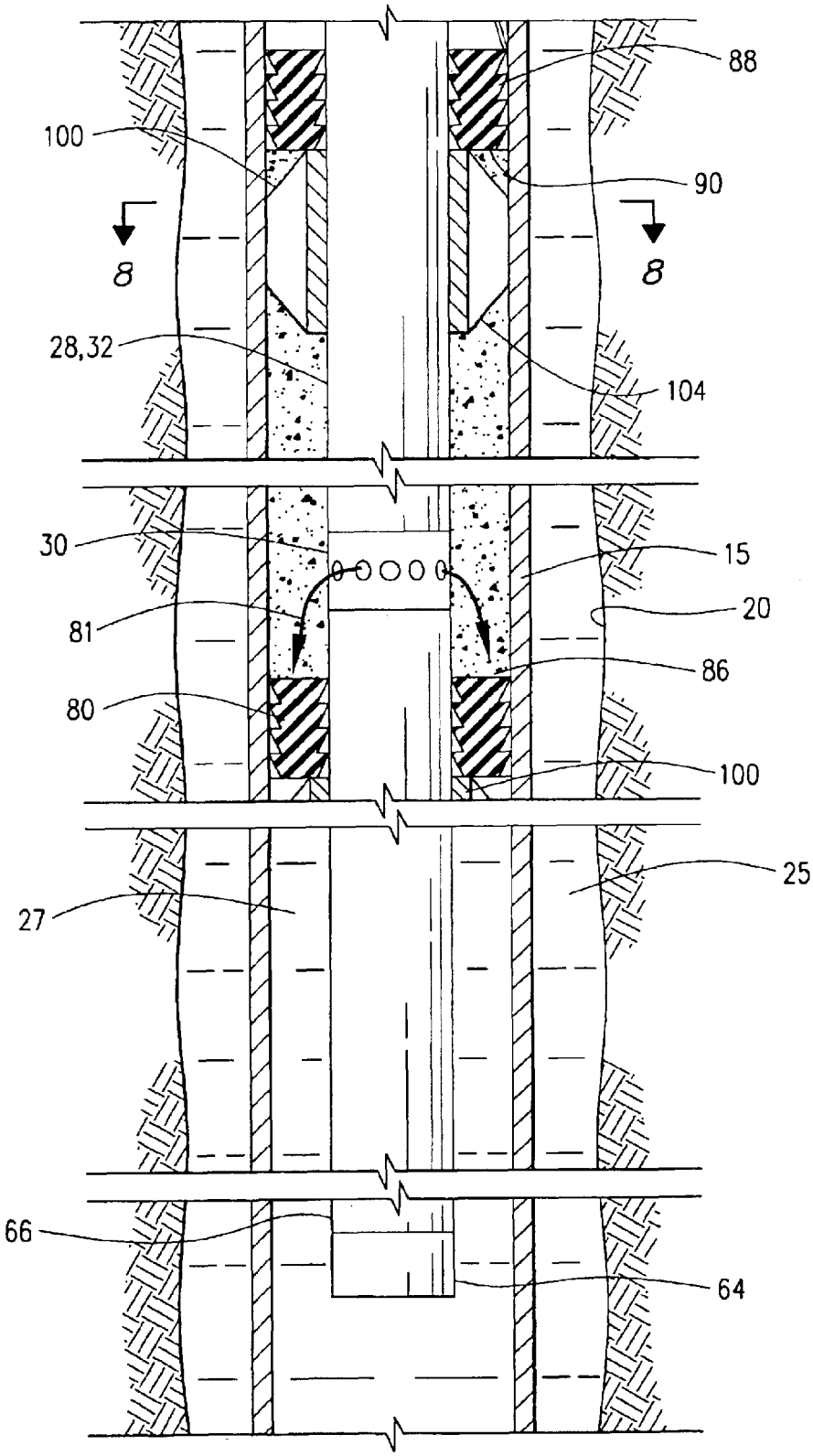
FIG. 2 is similar to FIG. 1 and shows the tubing with the foaming tool positioned in the casing after cementing operations have begun.
Figure 6:
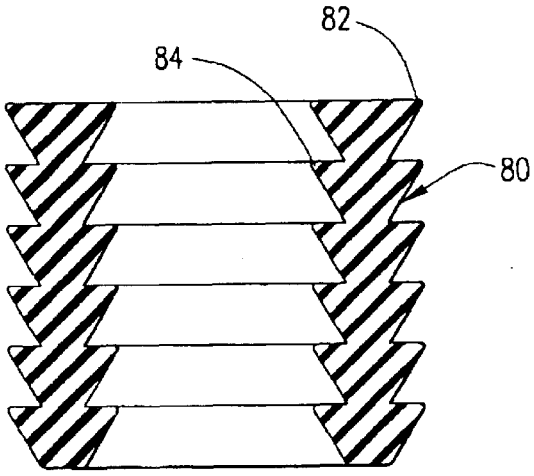
FIG. 6 is a bottom cementing plug of the present invention.

Once foamer 30 is positioned at the desired location downhole in the casing 15, a bottom cementing plug 80 is displaced into the casing 15. Plug containers may be utilized to displace bottom cementing plug 80 into the casing 15. Bottom cementing plug 80 is shown in FIG. 6 and is similar to a standard cementing plug. However, rather than simply having outer wipers, bottom cementing plug 80 has outer wipers 82 and inner wipers 84. Outer wipers 82 will engage and wipe inner surface 17 of casing 15 while inner wipers 84 will engage and wipe an outer surface 83 of tubing 28. Bottom cementing plug 80 will therefore seal against tubing 28 until it passes bull plug 64. Cement is displaced into inner annulus 27 behind bottom cementing plug 80. FIG. 2 shows the foaming apparatus 10 after bottom cementing plug 80 has been displaced into the wellbore ahead of a leading edge 86 of the cement. Arrows 81 indicate the injection of gas through ports 44 into the cement displaced downwardly in inner annulus 27.

Figure 7:
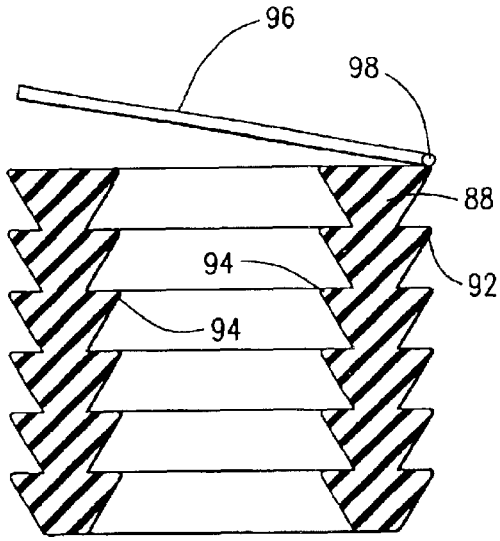
FIG. 7 is a top cementing plug of the present invention.

As shown in FIG. 2, once the desired amount of cement has been displaced downwardly in casing 15, a top cementing plug 88 is displaced behind a trailing edge 90 of the cement. Upper or top cementing plug 88 has outer wipers 92 and inner wipers 94 as shown in FIG. 7. Outer wipers 92 will engage and wipe inner surface 17 of casing 15 while inner wipers 94 will engage and wipe outer surface 83 of tubing 28. Top cementing plug 88 has a closable cap 96. As shown in FIG. 2, cap 96 will be held in an open position when top cementing plug 88 is being urged downwardly by a displacement fluid. Cap 96 may comprise a flapper-type valve with a spring-loaded hinge 98 to close cap 96. Tubing 28 will hold cap 96 in the open position. Once top cementing plug 88 passes bull plug 64, cap 96 will automatically move to a closed position and top cementing plug 88 will continue to be urged downwardly by the displacement fluid to force cement out the lower end of casing 15. Top cementing plug 88 will be inserted into a plug injector with cap 96 in its open position. The plug injector may be modified to hold, or trap the cap or flapper 96 in its open position.

Figure 8:
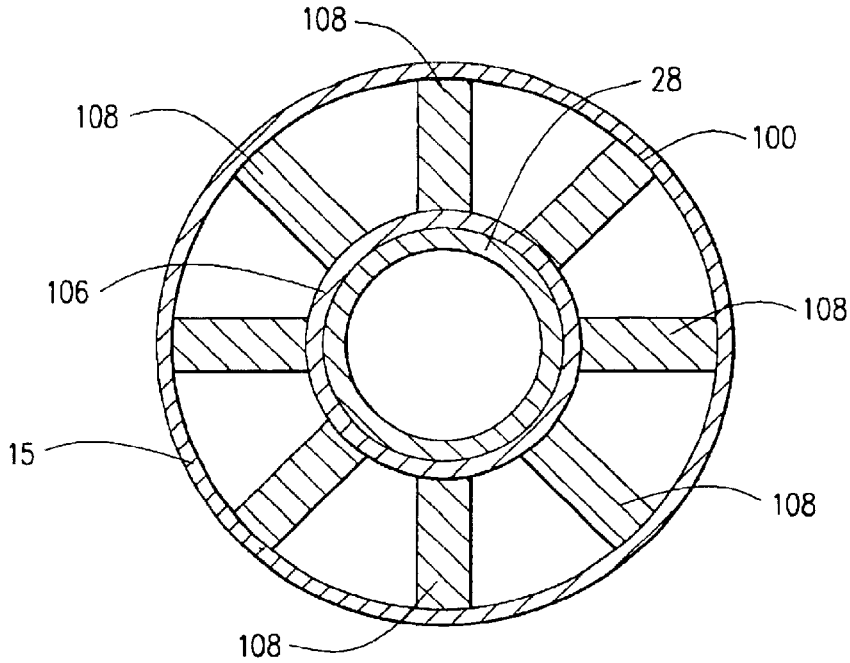
FIG. 8 is a view taken from line 8—8 of FIG. 2.
Figure 9:
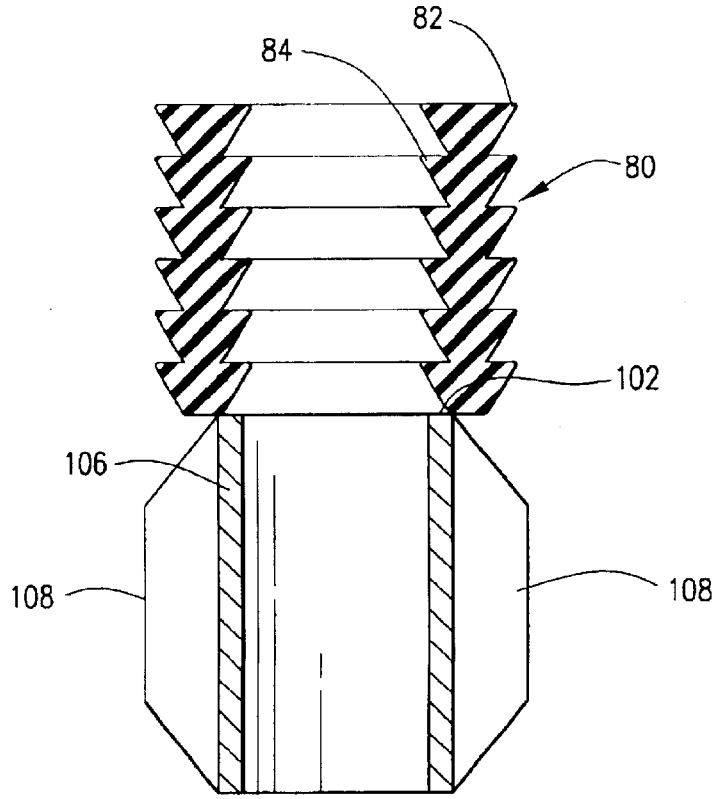
FIG. 9 shows a bottom cementing plug of the present invention with a centralizer attached thereto.

A centralizer 100, which may be referred to as star centralizer 100, may be connected to each of the lower ends of bottom cementing plug 80 and top cementing plug 88. Centralizer 100 comprises an upper end 102, a lower end 104, and has a central sleeve 106 as shown in FIG. 9. A plurality of wings 108 are connected to central sleeve 106, and extend outwardly therefrom as shown in FIG. 8. Centralizers 100 will centralize tubing 28 ahead of bottom and top cementing plugs 80 and 88 as they travel downwardly in casing 15. Centralizers 100 may be connected to top and bottom cementing plugs 88 and 80 with fasteners or other means known in the art. The plug injector used to displace bottom and top cementing plugs 80 and 88 may be modified to hold the bottom and top cementing plugs 80 and 88 with centralizers 100 attached thereto.

Tubing 28 will be lifted far enough away from any float apparatus in casing 15 so that clearance between bull plug 64 and the float apparatus is provided for both of top and bottom cementing plugs 88 and 80 and the centralizers 100 attached thereto. Centralizer 100 attached to bottom cementing plug 80 will land on the float apparatus and cement will be pumped through bottom cementing plug 80 and the float apparatus into outer annulus 25. Top cementing plug 88 is placed in casing 15 behind the trailing edge 90 of the cement, and the centralizer 100 attached thereto will land on bottom cementing plug 80. Cap 96 will close when top cementing plug 88 clears bull plug 64, which will be urged downwardly until it engages bottom cementing plug 80.

As set forth above, the cement displaced into inner annulus 27 may include various surfactants known as foaming agents to facilitate foaming of the cement slurry and other surfactants such as foam stabilizers. Other additives may also be included in the cement slurry. The cement slurry is foamed downhole by injecting nitrogen through tubing 28, and more specifically through upper tubing portion 32 into roamer 30 and through ports or nozzles 44. High pressure nitrogen is thus injected into the cement slurry through ports or openings 44. The injecting step begins when bottom cementing plug 80 passes foamer 30. To foam the cement slurry, nitrogen must be injected at a relatively high pressure. For example, localized ambient pressure in wells may be between 1,000 and 4,000 psig. Nitrogen can be pumped into tubing 28 at 5,000 to 9,000 psi which would generate approximately 1,000 to 5,000 psig pressure drop through openings 44 so that the foam texture of the cement will be adequate.

It is desired that the quality of the cement be essentially the same from the top of the cement to the bottom of the cement column. To control the quality so that it is consistent from the top to the bottom of the cement, the flow of nitrogen must be adjusted to increase functionally with the expected pressure and temperature at the final location. Thus, the amount of nitrogen injected into the cement slurry will increase from leading edge 86 to trailing edge 90 and will preferably increase linearly. The amount of nitrogen that must be injected and the rate of increase can be computed utilizing computer models. Computations that may be utilized to determine the amount of nitrogen to be injected may be summarized as follows. The pressure/volume/temperature (PVT) relationships for nitrogen may be expressed by the equation 144 pv=RT, where p is pressure in psi, R is a gas constant, and for nitrogen is 55.2 ft-lb/lbF, v is specific volume in $ft^3$/lb, and T is the temperature of the nitrogen. One approach to computing the injection rate of nitrogen is to use 38% as the desired quality throughout. Using the relationships already described, Vliq=1.63 Vgas at each point in the well for a 38% foam cement. The pressure, Px, from the top to the bottom of the cement can be computed using the foregoing equations, and the volume of gas pumped at the surface (in scfm/bpm) can be computed.

The nitrogen rate may also be calculated by using a fixed pressure gradient designated Px. Px can be computed as Px=x*pgrad+C, where C is typically a small number equivalent to the value of squeeze pressure on top of the cement, x is the depth to the point of interest, and pgrad is the pressure gradient of the slurry gas mixture. Note that in this case, the density of the gas changes with the depth. The value of v, the specific volume of the gas can be computed for each point using the above equations (144 pv=RT). Then using the equation (1/v+Y*slurry density)/(1+Y)= pgrad*144 the value of Y, which is the volume of cement to be mixed with a cubic foot of nitrogen at the specific pressure, may be determined. The volume of gas to be pumped can again be computed in scfm/bpm. The previous two methods are only exemplary methods, and not intended to be exclusive. They are shown here to demonstrate two conventional approaches that may be elected by a job designer.

The foregoing descriptions of specific embodiments of the present invention have been presented for purposes of illustration and description, they are not intended to be exhaustive or to limit the invention to the precise forms disclosed but obviously many modifications and variations are possible in light of the above teaching. The embodiments were chosen and described in order to best explain the principles of the invention and its practical application, and thereby enable others skilled in the art to best utilize the invention and various embodiments with various modifications that are suited to the particular use contemplated. It is intended that the scope of the invention be defined by the claims appended hereto and their equivalents.

What is claimed is:

1. A method of cementing a casing in a wellbore, the method comprising the steps of:

displacing cement downwardly in an annulus between a tubing lowered into the casing and the casing so that it exits the casing and enters an annulus between the casing and the wellbore; and injecting a gas into the cement in the annulus between the tubing and the casing at a predetermined location in the casing.

2. The method of claim 1, wherein the gas comprises nitrogen.

3. The method of claim 1, further comprising the steps of:

connecting a ported sub to a tubing; and lowering the tubing into the casing;

wherein the step of injecting comprises the step of injecting nitrogen into the casing through the tubing and the ported sub.

4. The method of claim 3, wherein the step of injecting begins approximately when a leading edge of the cement passes the ported sub in the casing.

5. The method of claim 1, further comprising the steps of:

connecting a ported sub to an upper end of a lower tubing section of the tubing;

connecting an upper tubing section of the tubing to the ported sub; and lowering the ported sub into the wellbore with the upper and lower tubing sections;

wherein the step of displacing comprises the step of displacing cement downwardly in an annulus between the upper tubing section and the casing, and the step of injecting comprises the step of injecting the gas into the cement as it passes the ported sub.

6. An apparatus for foaming cement used in cementing a casing in a wellbore, the casing and the wellbore defining an outer annulus therebetween, the apparatus comprising:

a tubing lowered into the casing, wherein the tubing and the casing define an inner annulus therebetween; and a ported sub connected in the tubing;

wherein a gas injected into the casing through the ported sub foams cement being displaced downwardly through the inner annulus, and the foam cement fills at least a portion of the outer annulus to cement the casing in the wellbore.

7. The apparatus of claim 6, wherein the tubing further comprises:

an upper tubing portion; and a lower tubing portion;

wherein the ported sub is connected between the upper tubing portion and the lower tubing portion.

8. The apparatus of claim 7, wherein the lower tubing portion is plugged at a lower end thereof.

9. The apparatus of claim 6, further comprising:

a bottom cementing plug disposed in the inner annulus ahead of a leading edge of the cement; and a top cementing plug disposed in the inner annulus behind a trailing edge of the cement.

10. The apparatus of claim 9, wherein the bottom and top cementing plugs engage and wipe an inner surface of the casing and an outer surface of the tubing.

11. The apparatus of claim 10, wherein the top cementing plug comprises a closable cap, and the closable cap covers a central opening through the top cementing plug after the top cementing plug passes a lower end of the tubing.

12. The apparatus of claim 9, wherein the top and bottom cementing plugs comprise wipers on inner and outer sides thereof to wipe an inner surface of the casing and an outer surface of the tubing.

13. The apparatus of claim 6, wherein the ported sub comprises a housing having a plurality of downwardly sloped ports defined therethrough, and the gas is communicated from a central opening of the housing to the inner annulus through the downwardly sloped ports.

14. A method of cementing casing in a wellbore, the method comprising the steps of:

lowering a tubing in the casing;

displacing cement downwardly in an inner annulus between the casing and the tubing and out into an outer annulus between the casing and the wellbore; and foaming the cement in the annulus between the tubing and the casing.

15. The method of claim 14, wherein the step of foaming comprises the step of injecting a gas into the cement in the annulus between the tubing and the casing.

16. The method of claim 15, wherein the gas is nitrogen.

17. A method of foaming a cement used in cementing a casing in a wellbore, the method comprising the steps of:

lowering a plurality of nozzles into the casing on a tubing;

displacing the cement downwardly through the casing past the plurality of nozzles;

pumping a gas through the nozzles into the cement in an annulus between the tubing and the casing as the cement passes the nozzles to foam the cement; and placing the foam cement in an annulus between the casing and the wellbore.

18. The method of claim 17, wherein the step of lowering comprising the steps of:

connecting a ported sub in the tubing, wherein the nozzles are disposed in the ported sub; and lowering the tubing in the casing.

19. The method of claim 17, wherein the step of pumping comprises the step of pumping nitrogen through the tubing to generate at least a 1000 psig pressure drop through the nozzles.

20. The method of claim 17, further comprising the step of varying the rate of gas pumped through the nozzles to achieve a desired cement quality.

21. The method of claim 20, wherein the step of varying comprising the step of increasing the rate of gas pumped through the nozzles from a leading edge of the cement to a trailing edge of the cement.

22. The method of claim 20, wherein the desired cement quality is in the range of approximately 30–38%.

23. The method of claim 20, wherein the step of varying results in a pressure drop through the nozzles varying from about 1000 psig to about 5000 psig.

24. A method of cementing a casing in a wellbore, the method comprising the steps of:

displacing cement downwardly into the casing so that it exits the casing and enters an annulus between the casing and the wellbore;

connecting a ported sub to a tubing;

lowering the tubing into the casing;

injecting a gas into the cement at a predetermined location in the casing through theh tubing and the ported sub wherein the injecting step starts approximately when a leading edge of the cement passes the ported sub in the casing; and increasing a rate at which the gas is injected from the leading edge of the cement to a trailing edge of the cement.

25. The method of claim 24, wherein the rate at which the gas is injected is increased at a constant rate of increase from the leading edge to the trailing edge of the cement.

26. A method of cementing a casing in a wellbore, the method comprising the steps of:

connecting a ported sub to an upper end of a lower tubing section;

connecting an upper tubing section to the ported sub;

lowering the ported sub into the wellbore with the upper tubing section;

displacing cement downwardly in an annulus between the casing and the upper tubing section wherein the cement exits the casing and enters an annulus between the casing and the wellbore; and injecting a gas into the cement at a predetermined location in the casing as it passes the ported sub.

27. The method of claim 26, further comprising the steps of:

placing a bottom cementing plug in the annulus between the upper tubing section and the casing ahead of a leading edge of the cement; and placing a top cementing plug in the annulus between the upper tubing section and the casing behind a trailing edge of the cement.

28. The method of claim 27, further comprising the steps of:

beginning the step of injecting when the bottom cementing plug passes the ported sub; and ending the step of injecting when the top cementing plug passes the ported sub.

29. The method of claim 28 further comprising the step of increasing the rate of gas injected from the leading edge to the trailing edge of the cement.

30. A method of cementing casing in a wellbore, the method comprising the steps of:

connecting a jetting sub in a tubing;

lowering the tubing in the casing;

displacing cement downwardly in an annulus between the casing and the tubing, and out into an outer annulus between the casing and the wellbore; and injecting a gas into the cement through the jetting sub to foam the cement in the annulus between the tubing and the casing.

31. The method of claim 30, further comprising the step of increasing an injection rate of the gas from a leading edge of the cement to a trailing edge of the cement.

* * * * *